US006145172A

United States Patent [19]

Bourdon

[11] Patent Number: 6,145,172

[45] Date of Patent: Nov. 14, 2000

[54] LOCKING DEVICE FOR A SIDE-RELEASE BUCKLE

[76] Inventor: Ted Bourdon, 166 Deslandes, St. Thomas d'Aquin Quebec, Canada, J9X 2AO

[21] Appl. No.: 09/310,722

[22] Filed: May 13, 1999

[30] Foreign Application Priority Data

May 14, 1998 [CA] Canada ..... 2,237,660

[51] Int. Cl.[7] ..... A44B 11/25

[52] U.S. Cl. ..... 24/625; 24/616; 24/633

[58] Field of Search ..... 24/625, 633, 616, 24/615

[56] References Cited

U.S. PATENT DOCUMENTS

| | | | |
|---|---|---|---|
| 4,575,908 | 3/1986 | Gloomis et al. . | |
| 4,825,515 | 5/1989 | Wolterstorff, Jr. . | |
| 4,831,694 | 5/1989 | Kong | 24/625 |
| 5,144,725 | 9/1992 | Krauss . | |
| 5,222,279 | 6/1993 | Frano et al. | 24/625 |
| 5,311,649 | 5/1994 | Suh . | |
| 5,383,257 | 1/1995 | Krauss | 24/625 |
| 5,548,879 | 8/1996 | Wu . | |
| 5,794,316 | 8/1998 | Anscher | 24/625 |

FOREIGN PATENT DOCUMENTS

| | | |
|---|---|---|
| 2029078 | 4/1995 | Canada . |
| 0 363 121 | 4/1990 | European Pat. Off. . |
| 0 426 325 | 5/1991 | European Pat. Off. . |

*Primary Examiner*—Victor N. Sakran
*Attorney, Agent, or Firm*—Robert G. Hendry

[57] ABSTRACT

A locking device for a buckle including a male member and a female member having coupling apertures formed in opposing sides. The male member includes a pair of resilient arms having coupling tabs for cooperating with the coupling apertures of the female member. The female member has guide means for receiving a guide member on the male member during insertion of the male member into the female member. The female member is provided with a locking device in the form of a locking member slidable in a slot to a position where it prevents depression of one of the resilient arms to release the coupling tabs from the coupling apertures. The lock is released by sliding the locking member along the slot in a direction away from the resilient arm. Accidental or unauthorised release of the buckle can therefore be prevented by providing the locking device on a side of the female member next to the wearer.

4 Claims, 1 Drawing Sheet

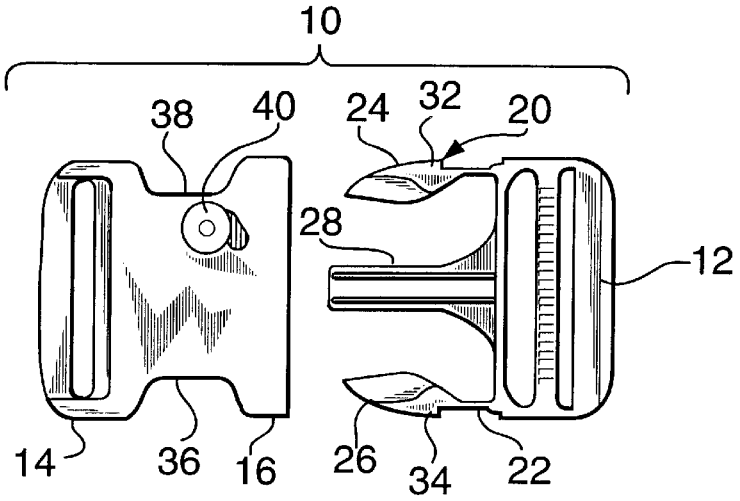
FIG. 1
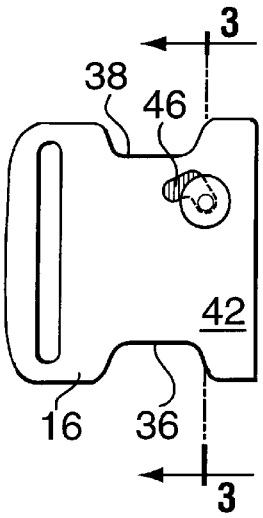
FIG.2
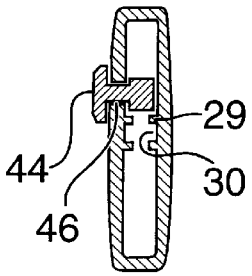
FIG.3
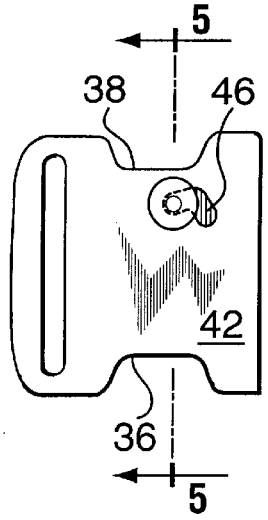
FIG.4
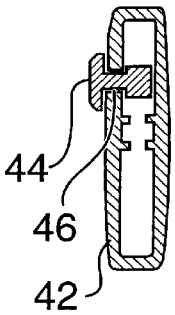
FIG.5
FIG.6
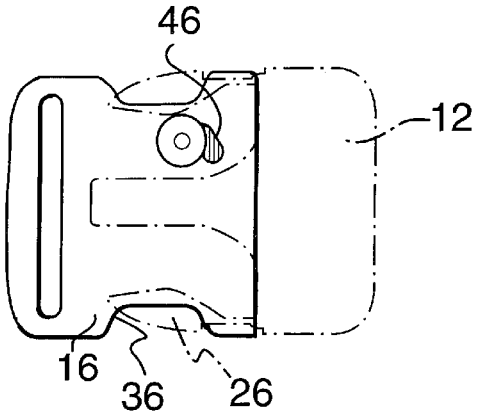
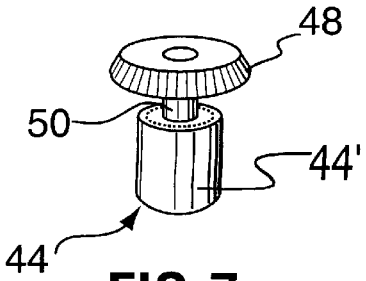
FIG.7

LOCKING DEVICE FOR A SIDE-RELEASE BUCKLE

BACKGROUND OF THE INVENTION

The present invention relates to buckles of the type having clasp members in the form of resilient arms received in a housing having coupling apertures to receive coupling tabs on the resilient arms and more particularly the invention relates to a locking device to minimize unauthorized or accidental movement of the resilient arms to uncouple the buckle.

Attempts to provide such a locking device for this buckle, hereinafter referred to as a side release buckle, have been primarily directed to accidental buckle release. The locking device for buckles disclosed in U.S. Pat. No. 5,144,725 to Krauss is for nylon belts as used for toolbelts, life preservers, seat belts and scuba equipment. Prior patents including the Krauss patent disclose locking devices on the exposed side of the buckle. The prior art locking devices are not intended to be concealed so as to inhibit unauthorized release.

Prior art locking devices are not designed so that the wearer can quickly unlock and uncouple the buckle with one hand. U.S. Pat. No. 4,825,515 to Wolsterstorff is designed to be unlocked and uncoupled using two hands. European Patent Applications EP 0 363 121 A2 and EP 0 426 325 A1 to Illinois Tool Works Inc. must be unlocked using a key. The prior art locking devices do not permit quick and easy locking and unlocking for the wearer, while at the same time inhibiting unauthorized or accidental release.

SUMMARY OF THE INVENTION

The present invention is directed to a locking device for side-release buckles which permits quick and easy locking and unlocking of the buckle by the wearer, while at the same time preventing unauthorized or accidental uncoupling of the buckle. As a specific example, to which no limitation is intended, this locking device may be utilized for side-release buckles on equipment belts worn by police officers or on waist pouches worn by tourists for carrying valuables. The locking device is designed so that it may be concealed from view, making it difficult for people other than the wearer to obtain unauthorized access to the locking device. The locking device is also designed so that it is comfortable when worn against the body, and so that the wearer can quickly and easily unlock and uncouple the buckle with one hand. The locking device is designed for use with buckles which exist in the prior art, and is simple and inexpensive to manufacture.

It is therefore an object of this invention to provide a means to prevent unauthorized or accidental uncoupling of a side-release buckle.

It is therefore a further object of this invention to provide a means to allow the wearer of the buckle to lock or unlock and uncouple the buckle quickly and easily with one hand.

It is therefore a still further object of this invention to provide a locking device which satisfies the foregoing objectives and is easy and inexpensive to manufacture.

Accordingly, the present invention provides a locking device for a buckle having separable co-operating male and female members, the male member having a first resilient arm on a lateral side of the male member and a second resilient arm on an opposite lateral side of the male member, the first resilient arm and the second resilient arm being inwardly deformable and having a coupling tab at a free end thereof; the female member having an outward-facing wall, a body-facing wall, and two lateral walls, defining a housing receptive to the male member; a first coupling aperture formed within a recess on one of the laterals walls, and adapted to releasably receive one of the coupling tabs; a second coupling aperture formed within a recess on the other lateral wall, and adapted to releasably receive one of the coupling tabs; the coupling tabs shaped so as to urge the first resilient arm and the second resilient arm inwardly as the male member is inserted into the housing of the female member, the first resilient arm and the second resilient arm biased toward a detent position when the coupling tabs align with the first and second coupling apertures; the locking device comprising a locking member movable between a locked position, wherein the locking member blocks one of the first resilient arm and the second resilient arm against inward deformation, and an unlocked position, wherein the locking member allows inward deformation of the first resilient arm and the second resilient arm.

Conveniently, the locking device comprises a slot in one of the body-facing wall or the outward-facing wall of the female member; the locking member captively engaged in the slot means and slidable between the locked position and the unlocked position. Preferably, the locking device is on the body-facing wall.

Conveniently, the locking member consists of an exterior gripping portion for manually actuating the locking member, a connecting portion extending through the slot means, and an interior projecting portion adapted to block one of the first and second resilient arms against inward deformation when the locking member is slid to a locked position, and to permit inward deformation of the first and second resilient arms when the locking member is slid to the unlocked position. Preferably, the connecting portion is cylindrical in shape, and the exterior gripping portion and interior projecting portion are button-like in shape; the connecting portion is integral with one of the interior projecting portion and the exterior gripping portion and is securely attached to the other of the interior projecting portion and the exterior gripping portion by adhesive attachment to a channel means within the interior projecting portion or the exterior gripping portion. Conveniently, the locking member is constructed of a synthetic plastic material.

BRIEF DESCRIPTION OF THE DRAWINGS

The foregoing and other objects and features of the present invention will become more apparent upon a consideration of the following description taken in connection with the accompanying drawings wherein:

FIG. 1 is a perspective view of the uncoupled male and female members of the buckle, showing an embodiment of the locking device.

FIG. 2 is a side view of the female member, showing the embodiment of FIG. 1, with the locking member in an unlocked position.

FIG. 3 is a cross-sectional view taken along line 3—3 of FIG. 2, with the locking member in an unlocked position.

FIG. 4 is a side view of the female member, further illustrating the embodiment of FIG. 1, with the locking member in a locked position.

FIG. 5 is a cross-sectional view taken along line 5—5 of FIG. 4, with the locking member in a locked position.

FIG. 6 is a side view, partly in phantom, of the buckle in a coupled condition, showing the relationship of the locking member to a resilient arm of the male member, when the locking member is in the locked position.

FIG. 7 is a side perspective view of the locking member of FIG. 1.

DETAILED DESCRIPTION OF THE PREFERRED EMBODIMENT

Referring now in detail to the drawings, FIG. 1 discloses a buckle 10 including a male member 12 and a female member 14 having a housing 16. The male member 12 has a first and second resilient arm 20 and 22 respectively, in a parallel spaced apart relationship, each of which has a coupling tab 24 and 26 at a free end thereof. The male member also has a guide member 28 intermediate the resilient arms 20 and 22 to cooperate with guide ribs 29 forming a channel 30 in the housing 16. The male member has a pair of hook portions 32 and 34 to engage edges of apertures 36 and 38 on opposite lateral sides of the housing 16, which are adapted to snappingly engage with the coupling tabs 24 and 26. The housing 16 has a locking device 40 on a selected side 42 of the housing 16, which is adapted to be comfortable when worn against the body. The locking device 40 has a locking member 44 which is slidable within a slot 46 between a locked position and an unlocked position. The slot 46 has a bent configuration which is adapted to allow easy activation of the locking device 40 by the wearer, while at the same time preventing the locking member 44 from accidentally sliding between the locked and unlocked position. The locking member 44 includes an exterior gripping portion 48 joined to the interior projecting portion 44' by a connecting portion 50 received in the slot 46.

In use, the buckle 10 is coupled by inserting the male member 12 into the housing 16 of the female member 14. The locking tabs 24 and 26 of the first and second resilient arms 20 and 22 are shaped so as to deform inwardly when the male member 12 is inserted into the housing 16, and the first and second resilient arms 20 and 22 are biased to return to a parallel position when the coupling tabs 24 and 26 are aligned with the coupling apertures 36 and 38, such that the coupling tabs 24 and 26 snappingly engage with the coupling apertures 36 and 38, thereby coupling the male member 12 and the female member 14 together. The buckle 10 may be uncoupled by depressing the first and second resilient arms 20 and 22.

To prevent unauthorized or accidental uncoupling of the male member 12 and female member 14, the locking member 44 may be slid along the slot 46 to the locked position, where it prevents the depression of one of the first and second resilient arms 20 and 22. To unlock the buckle 10, the locking member 44 may be slid along the slot 46 to the unlocked position, where it does not interfere with the depression of the first and second resilient arms 20 and 22.

The above description is given on a single preferred embodiment of the invention, however it will be apparent that modifications and variations could be effected by one skilled in the art without departing from the spirit or scope of the novel concepts of the invention as defined in the claim.

What is claimed is:

1. A locking device for a buckle having separable co-operating male and female members, said male member having a first resilient arm on a lateral side of said male member and a second resilient arm on an opposite lateral side of said male member, said first resilient arm and said second resilient arm being inwardly deformable and having a coupling tab at a free end thereof;

said female member having an outward-facing wall, a body-facing wall, and two lateral walls, defining a housing receptive to said male member;

a first coupling aperture formed within a recess on one of the laterals walls, and adapted to releasably receive one of said coupling tabs;

a second coupling aperture formed within a recess on the other lateral wall, and adapted to releasably receive one of said coupling tabs;

said coupling tabs shaped so as to urge said first resilient arm and said second resilient arm inwardly as said male member is inserted into the housing of the female member, said first resilient arm and said second resilient arm biased toward a detent position when said coupling tabs align with said first and second coupling apertures;

said locking device comprising:

a locking member movable between a locked position, wherein the locking member blocks one of said first resilient arm and said second resilient arm against inward deformation, and an unlocked position, wherein the locking member allows inward deformation of said first resilient arm and said second resilient arm;

a slot means having a bent configuration in one of said body-facing wall or said outward-facing wall of said female member;

said locking member captively engaged in said slot means and diagonally slidable between the locked position and the unlocked position.

2. A locking device as defined in claim 1 wherein said locking member has an exterior gripping portion for manually actuating said locking member, a connecting portion extending through said slot means, and an interior projecting portion adapted to block one of said first and second resilient arms against inward deformation when the locking member is slid to a locked position, and to permit inward deformation of said first and second resilient arms when the locking member is slid to the unlocked position.

3. A locking device as defined in claim 1 wherein said locking device is on the body-facing wall.

4. A locking device as defined in claim 1 wherein said connecting portion is cylindrical in shape, and said exterior gripping portion and said interior projecting portion are button-like in shape.

* * * * *